US006989064B2

(12) United States Patent
Kneisl

(10) Patent No.: US 6,989,064 B2
(45) Date of Patent: Jan. 24, 2006

(54) HI-TEMP EXPLOSIVE BINDER

(75) Inventor: Philip Kneisl, Pearland, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 10/325,993

(22) Filed: Dec. 19, 2002

(65) Prior Publication Data

US 2004/0050466 A1 Mar. 18, 2004

Related U.S. Application Data

(60) Provisional application No. 60/410,358, filed on Sep. 13, 2002.

(51) Int. Cl.
*C06B 45/10* (2006.01)

(52) U.S. Cl. ..... 149/19.3

(58) Field of Classification Search ..... 149/19.3
See application file for complete search history.

(56) References Cited

U.S. PATENT DOCUMENTS

| | | | | |
|---|---|---|---|---|
| 4,554,031 | A * | 11/1985 | Kerviel et al. | 149/19.3 |
| 5,049,213 | A * | 9/1991 | Chan et al. | 149/19.3 |
| 6,005,037 | A * | 12/1999 | Scheckenbach et al. | 524/278 |
| 6,365,684 | B1 * | 4/2002 | McCarthy et al. | 526/81 |
| 6,593,410 | B2 * | 7/2003 | Nielson et al. | 524/439 |
| 2002/0189482 | A1 * | 12/2002 | Kneisl et al. | 102/306 |

* cited by examiner

*Primary Examiner*—John R. Hardee

(74) *Attorney, Agent, or Firm*—G. Alan Witte; Bryan P. Galloway; Jaime A. Castaño

(57) ABSTRACT

The present invention provides high temperature explosive binders. More specifically, the present invention provides thermally stable polymeric binders for use in pressed explosives and suitable for environments such as the oilfield environment.

1 Claim, 1 Drawing Sheet

HI-TEMP EXPLOSIVE BINDER

This application claims the benefit of U.S. Provisional Application No. 60/410,358 filed Sep. 13, 2002.

FIELD OF THE INVENTION

The subject matter of the present invention relates to high temperature explosive binders. More specifically, the subject matter of the present invention relates to thermally stable polymeric binders for use in pressed explosives and suitable for environments such as the oilfield environment.

BACKGROUND OF THE INVENTION

Pressed explosives are the explosives of choice for oilfield perforators. Pressing the explosive allows high volume production of precision shaped charges whereas casting or molding, the other two common production methods, do not. Critical to the pressing operation is the explosive molding powder itself. To date the vast majority of oilfield perforating charges are manufactured using wax coated PETN, RDX and HMX based explosives. The wax coating enables the explosive crystals to form into a pellet with adequate physical strength and dimensional stability when the formulation is pressed. The wax also serves to "desensitize" the explosive particles making them less prone to initiation when exposed to friction or impact.

In recent years the military has developed many pressed explosives with polymeric binders, so called "plastic bonded explosives" (PBX). PBX formulations offer several advantages over the standard "waxed" explosives. In general a PBX explosive formulation is made up of agglomerates of explosive crystals stuck together with polymer. "Waxed" formulations more closely resemble individually coated explosive crystals with little agglomeration. Therefore the flow, handling and molding properties of a PBX are typically much superior to those of a "waxed" explosive. The pressed PBX pellet is also much stronger, and is less sensitive to friction and impact.

The use of PBX explosives has been mostly limited to military and aerospace applications. The primary reason for this is that the typical polymeric binders used by the military do not have sufficient thermal stability for use in the oilfield environment. For example PBX's made with Ethylene Vinyl Acetate (EVA), Estane (a polyurethane) and Cellulose Acetate Butylrate (CAB) are important militarily, but are not useful at oil well temperatures because they undergo accelerated decomposition at higher temperatures. Further, most PBX formulations require heating the powder to elevated temperatures to soften the binder to allow compaction to high density.

Other reasons that polymeric binders have not been used in the oilfield market are time dependent stress relaxation of the polymers, which causes dimensional changes in the pressed charge over time, and liner cracking during the pressing process. As a result of these two complications a two-step shaped-charge loading process is typically used with PBX based explosives. The explosive formulation is first pressed to shape at a high density and then the shaped charge liner is inserted.

DETAILED DESCRIPTION OF PREFERRED EMBODIMENTS

Figure 1:
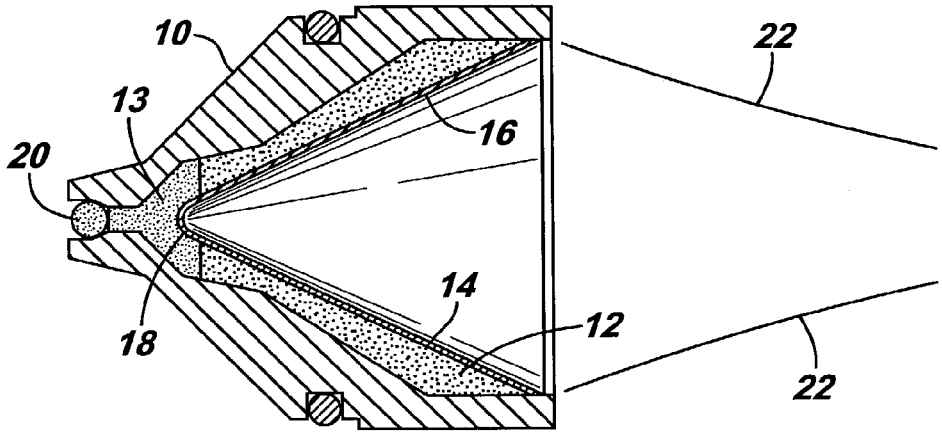
FIG. 1 illustrates an embodiment of the present invention utilized in a perforating shaped charge.

The thermally stable polymeric explosive binders of the present invention are those suitable for use in the oilfield environment. In addition, the explosive binders can also be used to advantage in operations within gas wells, water wells, injection wells, and control wells. Furthermore, the thermally stable polymeric explosive binders of the present invention also have applicability commercially, militarily, and in the aerospace industry.

One embodiment of the thermally stable polymeric binders of the present invention is THV-220G™, a terpolymer of tetrafluoroethylene, hexafluoropror,ylene and vinylidene fluoride (made by Dyneon LLC, 6744 33$^{rd}$ Street North, Oakdale, Minn., 55128), preferably 10–50% plasticized with LFC-1™ liquid fluoroelastomer (made by 3M Chemicals, 3M Center, St. Paul, Minn., 55144). A PBX molding powder with nice granulation and pressing characteristics is produced by coating class 1 HMX with 3 percent by weight of a 90% THV/10% LFC blend. In addition to class 1 HMX, the THV/LFC blend is particularly useful as a binder with PETN, RDX, CL-20, NTO and other explosive compounds having thermal stabilities less than or equal to HMX.

It should be understood that plasticization of the THV-220G™ with LFC-1 is not necessary and explosive molding powders can be made without adding LFC-1. Explosive formulations based on THV-220G™ (plasticized or unplasticized with LFC-1) possess excellent thermal stability up to 400° F. for 140-minutes or 300 ° F. for 100-hours. This binder also has the ability to "single pass" charges in production, i.e. to compact the explosive formulation and insert the shaped charge liner in a single pressing step. Additionally, formulations made with this binder can be pressed to a high density at ambient temperature and without pulling a vacuum on the die to remove air prior to pressing.

Tables I and II to follow provide the results of a Temperature Vacuum Stability Test for the above mentioned thermally stable polymeric explosive binder. The tables demonstrate the temperature/time suitability for the 90% THV/10% LFC blend at temperatures of 400° Fahrenheit and 300°. The explosive binders sustain minimal gas loss while being exposed to the elevated temperature for extended period of time.

TABLE I

400° Temperature Vacuum Stability Tests (THV-220G ™)

| Ampule | Time (minutes) | Evolved Gas (cc/gm) |
|---|---|---|
| 1 (HMX) | 20 | 1.2044 |
| 2 (HMX) | 20 | 1.4285 |
| 3 (HMX) | 140 | 3.6545 |
| 4 (HMX) | 140 | 3.4280 |

TABLE II

300° Temperature Vacuum Stability Tests (THV-220G ™)

| Ampule | Time (hours) | Evolved Gas (cc/gm) |
|---|---|---|
| 1 (HMX) | 100 | 5.9637 |
| 2 (HMX) | 100 | 9.3793 |
| 3 (HMX) | 100 | 7.3686 |

TABLE II-continued

| 300° Temperature Vacuum Stability Tests (THV-220G ™) | | |
|---|---|---|
| Ampule | Time (hours) | Evolved Gas (cc/gm) |
| 4 (HMX) | 100 | 6.8804 |
| 5 (HMX) | 100 | 11.8710 |
| 6 (HMX) | 100 | 10.9849 |

Formulations made with this binder are also suitable for extrusion processing. The extrusion process may be performed at ambient temperatures or at elevated temperatures depending upon operator preference.

Another embodiment of the thermally stable polymeric binder is a family of polychloro trifluoroethylene (PCTFE) waxes (made by Halocarbon Products Corp., P.O. Box 661, River Edge, N.J. 07661) identified to be especially well suited to very high temperature applications. In one embodiment, the PCTFE waxes are preferably less than 10% plasticized.

Coating class 1 HMX with Halocarbon 1500 wax and Halocarbon 2300 wax produces two PBX molding powders with nice granulations and pressing characteristics. Because Halocarbon type 40, 600 and 1200 PCTFE waxes have identical chemical and physical properties, they can also be used to advantage in the present invention. Similarly PCTFE waxes made by AtoFina should also prove useful. PCTFE waxes may also be plasticized with lower molecular weight PCTFE oils to improve their mechanical behavior without affecting thermal stability.

PCTFE wax used as a binder acts as a suitable substitute for Kel-F-800 (also known as FK-800, polychloro trifluoroethylene vinylidene fluoride copolymer). When PCTFE wax is used with the proper explosives, PCTFE waxes and oils produce formulations with excellent thermal stability meeting, and depending upon the explosive selected, exceed the time-temperature requirements of 500° F. for 140-minutes and 460° F. for 100-hours. Explosives that can be successfully used with PCTFE waxes and oils include PETN, RDX, HMX, HNS, PYX, octanitroterphenyl (ONT), nonanitroterphenyl (NONA), CL-20, and NTO.

Tables III and IV to follow provide the results of a Temperature Vacuum Stability Test for the above mentioned thermally stable polymeric explosive binder. The tables demonstrate the temperature/time suitability for the PCTFE wax, used as a binder for HNS, at temperatures of 500° Fahrenheit and 460°. The explosive binders sustain minimal gas loss while being exposed to the elevated temperature for extended period of time.

TABLE III

| 500° Temperature Vacuum Stability Tests (PCTFE Gas) | | |
|---|---|---|
| Ampule | Time (minutes) | Evolved Gas (cc/gm) |
| 1 (HNS) | 140 | 0.9041 |
| 2 (HNS) | 140 | 0.8535 |
| 3 (HNS1500) | 140 | 0.9317 |
| 4 (HNS1500) | 140 | 1.1492 |
| 5 (HNS2300) | 140 | 0.8901 |

TABLE IV

| 460° Temperature Vacuum Stability Tests (PCTFE Wax) | | |
|---|---|---|
| Ampule | Time (hours) | Evolved Gas (cc/gm) |
| 1 (HC1500) | 100 | 3.9086 |
| 2 (HC1500) | 100 | 4.0332 |
| 3 (HC2300) | 100 | 3.9851 |
| 4 (HC2300) | 100 | 3.9465 |
| 5 (HNS (Uncoated)) | 100 | 4.4197 |
| 6 (HNS (Uncoated)) | 100 | 4.0677 |

PCTFE wax binders have the ability to "single pass" charges in production, i.e. to compact the explosive formulation and insert the shaped charge liner in a single pressing step. Additionally, formulations made with PCTFE wax can be pressed to a high density at ambient temperature and without pulling a vacuum on the die to remove air prior to pressing.

Formulations made with PCTFE wax are also suitable for extrusion processing. The extrusion process may be performed at ambient temperatures or at elevated temperatures depending upon operator preference.

One example oilfield application for the thermally stable polymeric explosive binders is described with reference to FIG. 1 which illustrates a typical shaped charge adapted for use in a perforating gun. The perforating gun is adapted to be disposed in a wellbore. Some shaped charges are discussed in U.S. Pat. No. 4,724,767 to Aseltine issued Feb. 16, 1988; U.S. Pat. No. 5,413,048 to Werner et al. issued May 9, 1995; and again in U.S. Pat. No. 5,597,974 to Voreck, Jr. et al. issued Jan. 28, 1997. Each of the above mentioned disclosures are incorporated by reference into this specification.

As shown in FIG. 1, the shaped charge includes a case 10, a main body of explosive material 12, which in the past has been, for example, RDX, HMX, PYX, or HNS packed against the inner wall of the case 10, a primer 13 disposed adjacent the main body of explosive 12 that is adapted to detonate the main body of explosive 12 when the primer 13 is detonated, and a liner 14 lining the primer 13 and the main body of explosive material 12. The shaped charge also includes an apex 18 and a skirt 16.

A detonating cord 20 contacts the case 10 of the shaped charge at a point near the apex 18 of the liner 14 of the charge. When a detonation wave propagates within the detonating cord 20, the detonation wave will detonate the primer 13. When the primer 13 is detonated, the detonation of the primer 13 will further detonate the main body of explosive 12 of the charge. In response to the detonation of the main body of explosive 12, the liner 14 will form a jet 22 that will propagate along a longitudinal axis of the shaped charge. The jet 22 will perforate a formation penetrated by the wellbore.

In an embodiment of the present invention, the main body of explosive 12 comprises a PBX explosive having a thermally stable polymeric explosive binder. Two exemplary binders are THV-220G™ and PCTFE wax. As discussed above, both binders have excellent thermal stability. Further, explosive formulations made with these binders can be pressed to high densities. Additionally, PCTFE wax is especially suited for high temperature applications.

In addition to oilfield applications, the explosive formulations made with this binder are also suitable for commercial, military, and aerospace applications.

Figure 2:
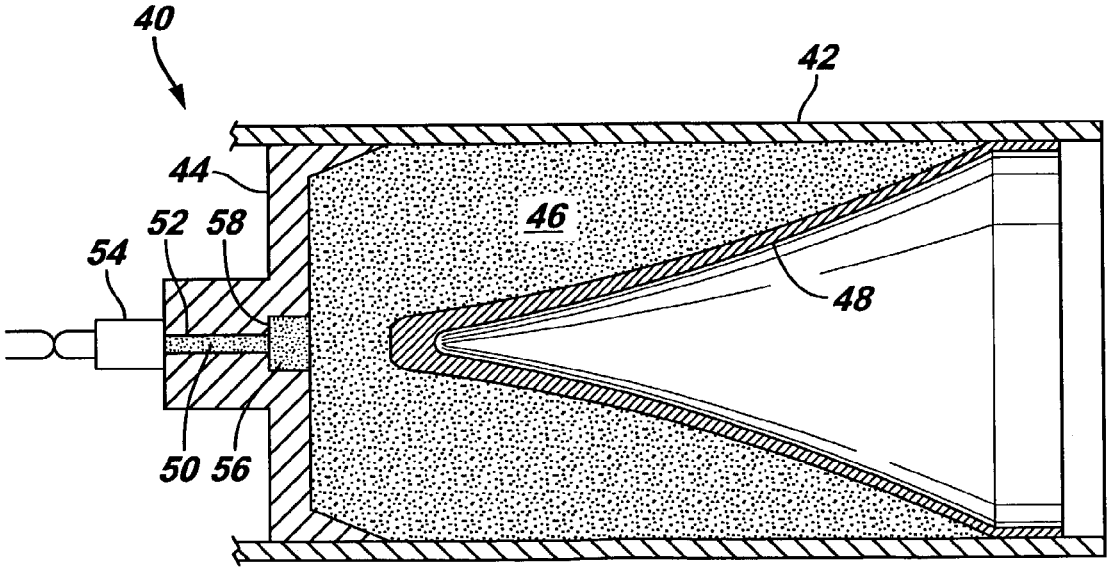
FIG. 2 illustrates an embodiment of the present invention utilized in a warhead munitions assembly.

One example military application is described with reference to FIG. 2 that illustrates a cross sectional view of a shaped charge explosive warhead munitions assembly 40. The shaped charge munitions assembly 40 is generally right circular cylindrically shaped and secured within a cylindrical case 42.

The shaped charge munitions assembly 40 includes an initiation assembly 44 containing a booster, a formed explosive charge 46, and a metal shaped charge liner 48. The initiation assembly 44 provides a housing for the formed explosive charge 46. A small booster charge 50 is contained within a central bore hole 52 located within the initiation assembly 44. The small booster charge 50 is generally initiated by a detonator 54 in contact therewith. A booster explosive pellet 56 is contained within a cylindrical cavity 58 that is in communication with the central bore hole 52.

In operation, the booster charge 50 is ignited by a triggering device as is well know in the art, such as by an exploding bridgewire detonator 54. Upon receiving the output from the detonator 54, the booster charge 50 contained within the bore hole 52 is ignited and the detonation therein travels forward within the borehole 52. During this transit, the explosive detonation wavefront becomes more nearly planar such that upon reaching the booster pellet 56, the output from the booster charge 50 is nearly concentric therewith and also with the main explosive charge 46 and the shaped charge liner 48.

The booster pellet 56 is ignited by the output from the small booster charge 50 so as to produce a detonation that is nearly concentric with the aforesaid component, which detonation propagates in a nearly spherical wavefront. Detonation of the main explosive charge 46 then acts upon the liner 48 to produce a desired metal jet.

In an embodiment of the present invention, the main body of explosive 46 comprises a PBX explosive having a thermally stable polymeric explosive binder. Two exemplary binders are THV-220G™ and PCTFE wax. As discussed above, both binders have excellent thermal stability. Further, explosive formulations made with these binders can be pressed to high densities. Additionally, PCTFE wax is especially suited for high temperature applications.

The invention being thus described, it will be obvious that the same may be varied in many ways. Such variations are not to be regarded as a departure from the spirit and scope of the invention, and all such are intended to be included within the scope of the following non-limiting claims.

What is claimed is:

1. A shaped charge, comprising:

a PBX explosive having a thermally stable polymeric binder composition comprising a terpolymer of tetrafluoroethylene, hexafluoropropylene and vinylidene fluoride.

* * * * *